US011247183B2

(12) United States Patent
Van Damme

(10) Patent No.: US 11,247,183 B2
(45) Date of Patent: Feb. 15, 2022

(54) BEVERAGE DISPENSING ASSEMBLY AND CONTAINER FOR USE IN A BEVERAGE DISPENSING ASSEMBLY

(71) Applicant: HEINEKEN SUPPLY CHAIN B.V., Amsterdam (NL)

(72) Inventor: Peter Albert Irma Van Damme, Oudenaarde (BE)

(73) Assignee: HEINEKEN SUPPLY CHAIN B.V., Amsterdam (NL)

( * ) Notice: Subject to any disclaimer, the term of this patent is extended or adjusted under 35 U.S.C. 154(b) by 73 days.

(21) Appl. No.: 16/360,602

(22) Filed: Mar. 21, 2019

(65) Prior Publication Data

US 2019/0217257 A1 Jul. 18, 2019

Related U.S. Application Data

(62) Division of application No. 14/646,600, filed as application No. PCT/NL2013/050841 on Nov. 22, 2013, now Pat. No. 10,258,940.

(30) Foreign Application Priority Data

Nov. 22, 2012 (NL) ..... 2009864

(51) Int. Cl.
*B01F 3/04* (2006.01)
*B67D 1/04* (2006.01)
(Continued)

(52) U.S. Cl.
CPC ..... *B01F 3/04808* (2013.01); *B67D 1/0406* (2013.01); *B67D 1/0462* (2013.01);
(Continued)

(58) Field of Classification Search
CPC ..... B67D 1/0406; B67D 1/04; B67D 1/0808; B67D 1/0462; B67D 1/0891;
(Continued)

(56) References Cited

U.S. PATENT DOCUMENTS 1,662,399 A 3/1928 Rood et al.
2,529,781 A 11/1950 Morrison
(Continued)

FOREIGN PATENT DOCUMENTS

DE 81032 C 1/1893
DE 663914 C 8/1938
(Continued)

OTHER PUBLICATIONS

"Multi component injection moulding" Simtec published Jul. 1, 2011 accessed at <https://www.simtec-silicone.com/two-shot-lsr-expertise-and-experience/> (Year: 2011).*
(Continued)

*Primary Examiner* — Stephen Hobson
(74) *Attorney, Agent, or Firm* — Pearne & Gordon LLP

(57) ABSTRACT

Beverage dispensing assembly, comprising a container and a tapping apparatus having a chamber in which the container fits and can be entered into through an opening closable by a lid, such that the container is enclosed between the lid and an opposite end of a chamber, wherein spaced apart from the lid and preferably at said opposite end of the chamber a first connector is provided, for feeding pressurised gas into the container through a gas inlet provided in the container, and at the side of the opening of the chamber a pressure element is provided for pressing the container with the gas inlet onto the first connector.

35 Claims, 9 Drawing Sheets

Figure 1B:
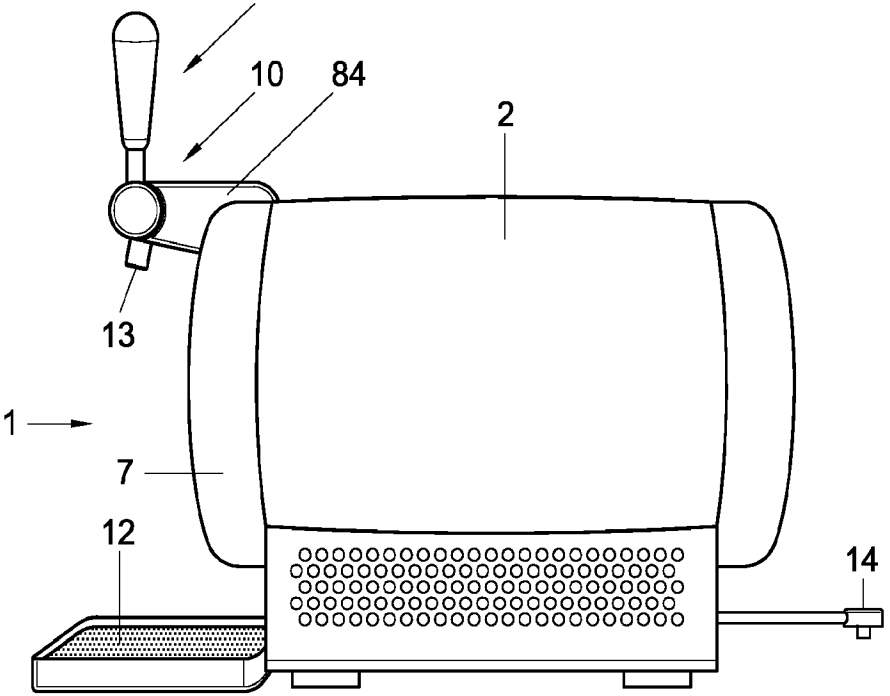

(51) Int. Cl.

| | |
|---|---|
| ***B67D 1/08*** | (2006.01) |
| *B67D 1/00* | (2006.01) |
| *G05G 5/06* | (2006.01) |
| *G05G 5/04* | (2006.01) |
| *G05G 5/05* | (2006.01) |
| *G05G 5/28* | (2006.01) |
| *G05G 5/00* | (2006.01) |
| *G05G 7/16* | (2006.01) |

(52) U.S. Cl.
CPC ..... *B67D 1/0808* (2013.01); *B67D 1/0891* (2013.01); *B67D 1/0001* (2013.01); *B67D 2001/0089* (2013.01); *G05G 5/00* (2013.01); *G05G 5/04* (2013.01); *G05G 5/05* (2013.01); *G05G 5/06* (2013.01); *G05G 5/28* (2013.01); *G05G 7/16* (2013.01)

(58) Field of Classification Search
CPC ..... B67D 2001/0089; B67D 1/0001; B01F 3/04808; G05G 7/16; G05G 5/06; G05G 5/04; G05G 5/05; G05G 5/28; G05G 5/00
See application file for complete search history.

(56) References Cited

U.S. PATENT DOCUMENTS

| | | | |
|---|---|---|---|
| 3,096,000 | A | 7/1963 | John et al. |
| 3,270,920 | A | 9/1966 | Nessler et al. |
| 3,381,841 | A | 5/1968 | Kusserow et al. |
| 3,410,456 | A | 11/1968 | Johnson et al. |
| 4,375,864 | A | 3/1983 | Savage |
| 4,665,940 | A | 5/1987 | Jacobson |
| 4,708,260 | A | 11/1987 | Siegal et al. |
| 4,921,135 | A | 5/1990 | Pleet |
| 5,251,787 | A | 10/1993 | Simson |
| 5,301,838 | A | 4/1994 | Schmidt et al. |
| 5,368,195 | A | 11/1994 | Pleet et al. |
| 5,396,934 | A | 3/1995 | Moench |
| 5,566,863 | A | 10/1996 | Mesenbring et al. |
| 6,360,923 | B1 | 3/2002 | Vlooswijk |
| 6,375,048 | B1 | 4/2002 | Van Der Meer et al. |
| 6,516,839 | B1 | 2/2003 | Timp |
| 6,530,401 | B1 | 3/2003 | Angehm |
| 7,032,781 | B2 | 4/2006 | Van Der Klaauw et al. |
| 7,140,514 | B2 | 11/2006 | Van Der Klaauw et al. |
| 7,188,751 | B2 | 3/2007 | Van Der Klaauw et al. |
| 7,390,375 | B2 | 6/2008 | Van Der Klaauw et al. |
| 8,079,496 | B2 | 12/2011 | Pakkert et al. |
| 8,757,439 | B2 | 6/2014 | Kambouris |
| 8,931,651 | B2 | 1/2015 | Van Hove et al. |
| 9,266,708 | B2 | 2/2016 | Rasmussen et al. |
| 9,284,177 | B2 | 3/2016 | Litto |
| 9,463,968 | B2 | 10/2016 | Schaefer et al. |
| 2002/0050496 | A1 | 5/2002 | Van Der Meer et al. |
| 2003/0071067 | A1* | 4/2003 | Sluijter ..... B67D 1/0462 222/183 |
| 2004/0007589 | A1 | 1/2004 | Leveen |
| 2004/0011828 | A1 | 1/2004 | Van Der Klaauw et al. |
| 2004/0069805 | A1 | 4/2004 | Van Der Klaauw et al. |
| 2004/0144810 | A1 | 7/2004 | Haglund et al. |
| 2004/0226967 | A1 | 11/2004 | Van Der Klaauw et al. |
| 2006/0278656 | A1 | 12/2006 | Ross |
| 2007/0056990 | A1* | 3/2007 | Pakkert ..... B67D 1/1405 222/146.6 |
| 2008/0257846 | A1 | 10/2008 | Hove et al. |
| 2008/0277422 | A1* | 11/2008 | Sommerfield ..... B67D 1/0412 222/152 |
| 2009/0108031 | A1* | 4/2009 | Anderson ..... B67D 1/0839 222/394 |
| 2009/0108032 | A1 | 4/2009 | Pakkert |
| 2010/0237035 | A1 | 9/2010 | Van Hove et al. |
| 2011/0017770 | A1 | 1/2011 | Maas et al. |
| 2012/0138161 | A1 | 6/2012 | Wolthers |
| 2013/0214000 | A1 | 8/2013 | Stratton |
| 2014/0004241 | A1 | 1/2014 | Hatherell |
| 2014/0034667 | A1 | 2/2014 | Peirsman et al. |
| 2014/0102570 | A1* | 4/2014 | Schaefer ..... B67D 3/0058 137/801 |
| 2014/0374443 | A1 | 12/2014 | Young et al. |

FOREIGN PATENT DOCUMENTS

| | | | |
|---|---|---|---|
| DE | 2363126 | A1 | 6/1975 |
| DE | 202005008320 | U1 | 7/2005 |
| EP | 1064221 | A1 | 1/2001 |
| EP | 2148771 | A1 | 2/2010 |
| GB | 821486 | | 10/1959 |
| GB | 2436828 | A | 10/2007 |
| JP | 2009196655 | A | 9/2009 |
| KR | 20030027842 | A | 4/2003 |
| NL | 1015368 | C2 | 12/2001 |
| NL | 1034419 | C2 | 3/2009 |
| WO | 9911563 | A1 | 3/1999 |
| WO | 9947451 | A1 | 9/1999 |
| WO | 0003944 | A1 | 1/2000 |
| WO | 2004101424 | A1 | 11/2004 |
| WO | 2006082486 | A1 | 8/2006 |
| WO | 2008129012 | A1 | 10/2008 |
| WO | 2009126034 | | 10/2009 |
| WO | 2010128151 | A1 | 11/2010 |
| WO | 2011002295 | A1 | 1/2011 |

OTHER PUBLICATIONS

Search Report received in corresponding Singapore Application No. 10201710068X dated Jan. 27, 2021, 2 pages.

* cited by examiner

BEVERAGE DISPENSING ASSEMBLY AND CONTAINER FOR USE IN A BEVERAGE DISPENSING ASSEMBLY

The invention relates to a beverage dispensing assembly. The invention further relates to a beverage container for use in a beverage dispensing assembly.

Beverage dispensing assemblies are known in the art in different constructions, for both on and off premise use.

It is known to dispense beverages such as carbonated beverages, especially beer from a rigid metal or wooden container such as a keg, barrel or cask by feeding pressurised gas, such as $CO_2$ into the container, forcing the beverage out of the container.

In an alternative system, as for example known from Heineken's DraughtKeg® and disclosed in for example EP1064221, a beverage container can be provided with an integrated, for example internal pressurizer, with which preferably automatically gas is introduced into the container in order to pressurise the beverage for dispensing and maintain as much as possible a constant pressure inside the container.

It has further been known, as is for example known from Heineken's BeerTender® and disclosed in WO00/03944, to dispense beverages from a bag-in-container type of container, in which a beverage is contained inside a flexible inner container, which is suspended in a more rigid outer container. In such system a pressurising gas can be inserted into the container, between the inner and outer container, thereby compressing the bag or inner container, squeezing out the beverage without the pressurising gas coming into direct contact with the beverage.

In EP2148771 an integrally blow moulded bag-in-container is disclosed, for holding and dispensing beverages, wherein at least one vent is provided running parallel to an interface between inner and outer containers, which vent opens to the atmosphere at a location adjacent to and orientated approximately coaxially with the bag-in-container's mouth. EP2148771 fails to disclose how this container is used in a dispensing assembly, especially how this is to be connected to a tapping line or tapping device.

WO2011/002295 further discloses a system in which a container is compressed within a pressure chamber, such that beverage contained within the container is dispensed. This requires a strong pressure chamber and an air tight closure of the pressure chamber to the container.

NL1034419 discloses a tapping assembly comprising a BIC type container having a gas inlet at bottom side of the container and a dispense assembly screwed onto the opposite neck side thereof. In this tapping assembly a standing cup is connected to the bottom of the container, which cup includes a one way valve for keeping the container pressurised after removal of the gas supply.

WO2010128151 discloses a tapping assembly comprising a BIC type container, again comprising an air inlet at a bottom end thereof, and a dispensing assembly screwed onto the neck end thereof. In this tapping assembly the container is placed onto a tapping apparatus, comprising an intermediate dosing chamber from which beverage is dispensed.

The present invention aims at providing an alternative tapping assembly. The present invention aims at providing a beverage dispensing assembly that is easy to operate and maintain. The present invention aims at a beverage tapping assembly requires relatively little space compared to the volume of beverage contained therein. The present invention aims at a beverage container which is suitable for storage and dispensing beverage in an easy and safe way. Any one of these aims can at least partly be achieved, individually or in combination, by a beverage dispensing device and/or beverage container according to this disclosure. Other aims and advantages may be alternatively or additionally be obtained by the invention.

In a first aspect the present invention can be characterised by a beverage dispensing assembly, comprising a container and a tapping apparatus having a chamber in which the container fits and can be entered into through an opening closable by a lid, such that the container is enclosed between the lid and a opposite end of a chamber. Spaced apart from the lid a first connector is provided, for feeding pressurised gas into the container through a gas inlet provided in the container. At the side of the opening of the chamber a pressure element is provided for pressing the container with the gas inlet onto the first connector. The first connector is preferably provided at said opposite end of the chamber, such that the container is pushed onto and/or into it when the container is inserted into the chamber through the opening.

In a second aspect the present invention can be characterised by a closure provided in and/or on the neck region of the container, with a substantially tubular element at the neck region, having a closed peripheral wall, and an operating element fitting inside said tubular element, slidingly sealing against the said wall. A cap is fitted at or near an end of the tubular element, closing off the tubular element, wherein the operating element can be pushed into the tubular element to such extend that it at least partly removes the cap from the tubular element and/or pierces said cap, for opening a passage from the container to a dispensing line connected to the operating element. The cap can be positioned at an end of the tubular element facing an inner space of the container, especially a beverage containing space.

In a third aspect the present invention can be characterised by a beverage container wherein a closure is provided in and/or on the neck region of the container, comprising a substantially tubular element at the neck region, having a closed peripheral wall, and an operating element fitting inside said tubular element, slidingly sealing against the said wall. A cap is fitted at or near an end of the tubular element, closing off the tubular element, wherein the operating element can be pushed into the tubular element to such extend that it at least partly removes the cap from the tubular element and/or pierces said cap, for opening a passage from the container to a tapping line connected to the operating element.

The tubular element with the cap can be made integrally, for example by multi component injection moulding, such as 2-K moulding. Alternatively the cap can be mounted to the tubular element in a different manner, for example by press fit or bonding, as long as it can be pushed at least partly away from the tubular element.

The operating element preferably is designed such that once it has been use for pushing the cap at least partly away, it locks in or behind part of the tubular element, such that it is locked in position and cannot be removed, at least not without damage, or reused, whereas it preferably extends at least partly beyond the position in which the cap was fitted, such that the cap cannot be pushed back into a position in which it closes off the tubular element.

Figure 1A:
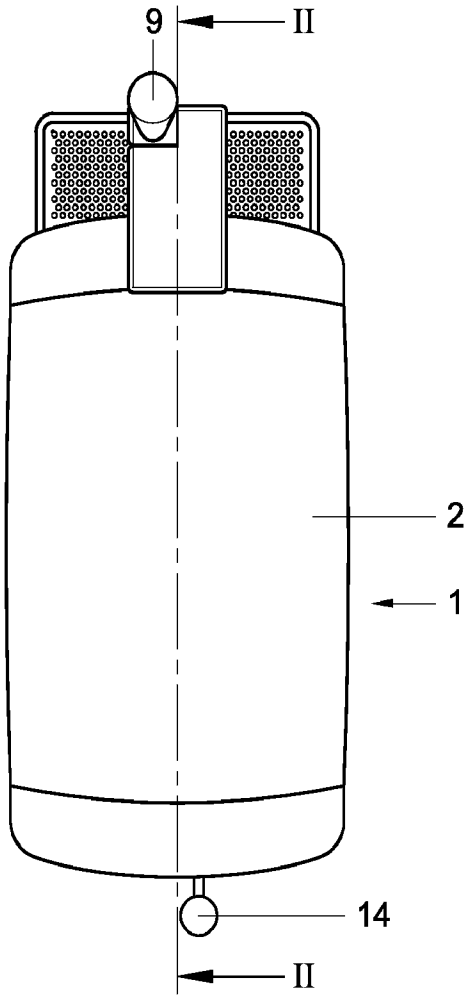
Figure 2:
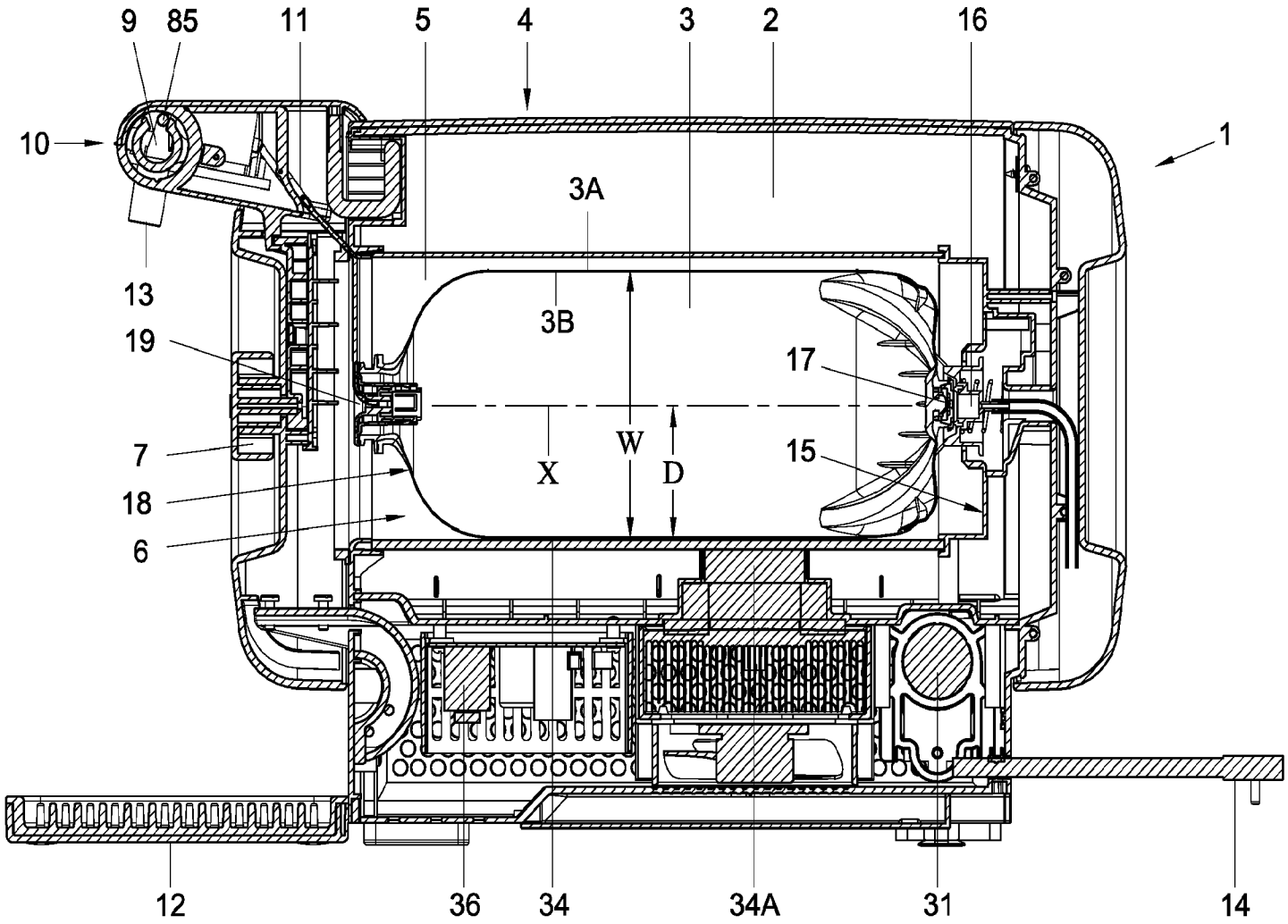
Figure 3:
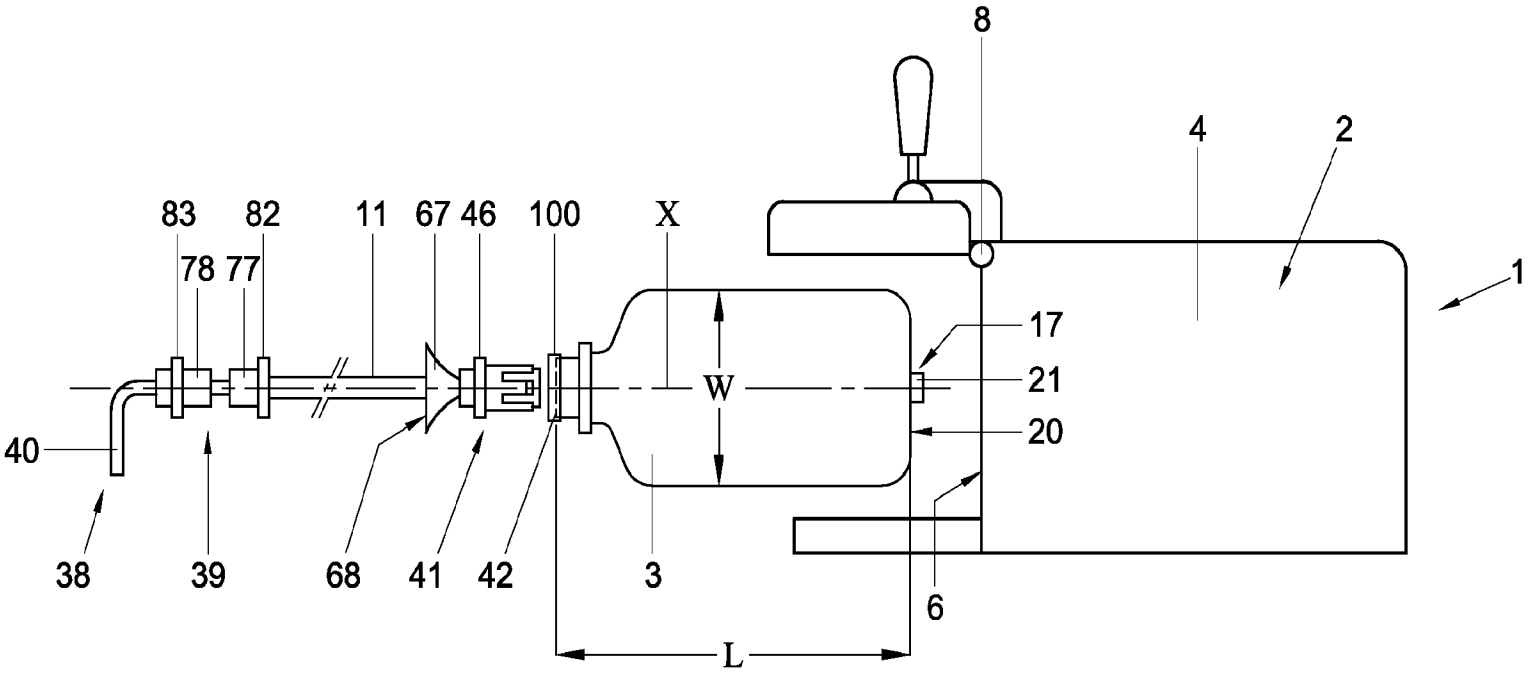
Figure 4:
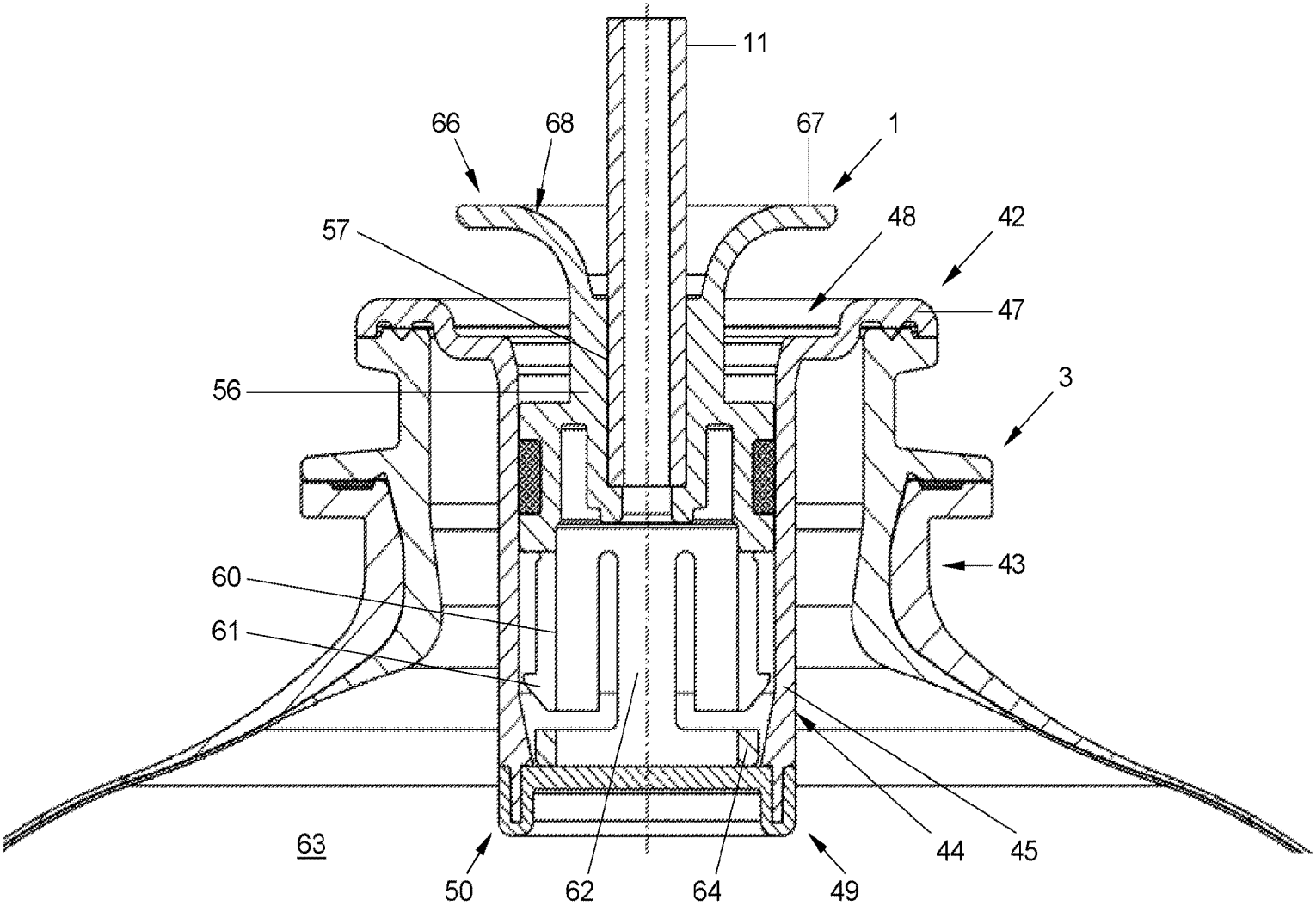
Figure 5:
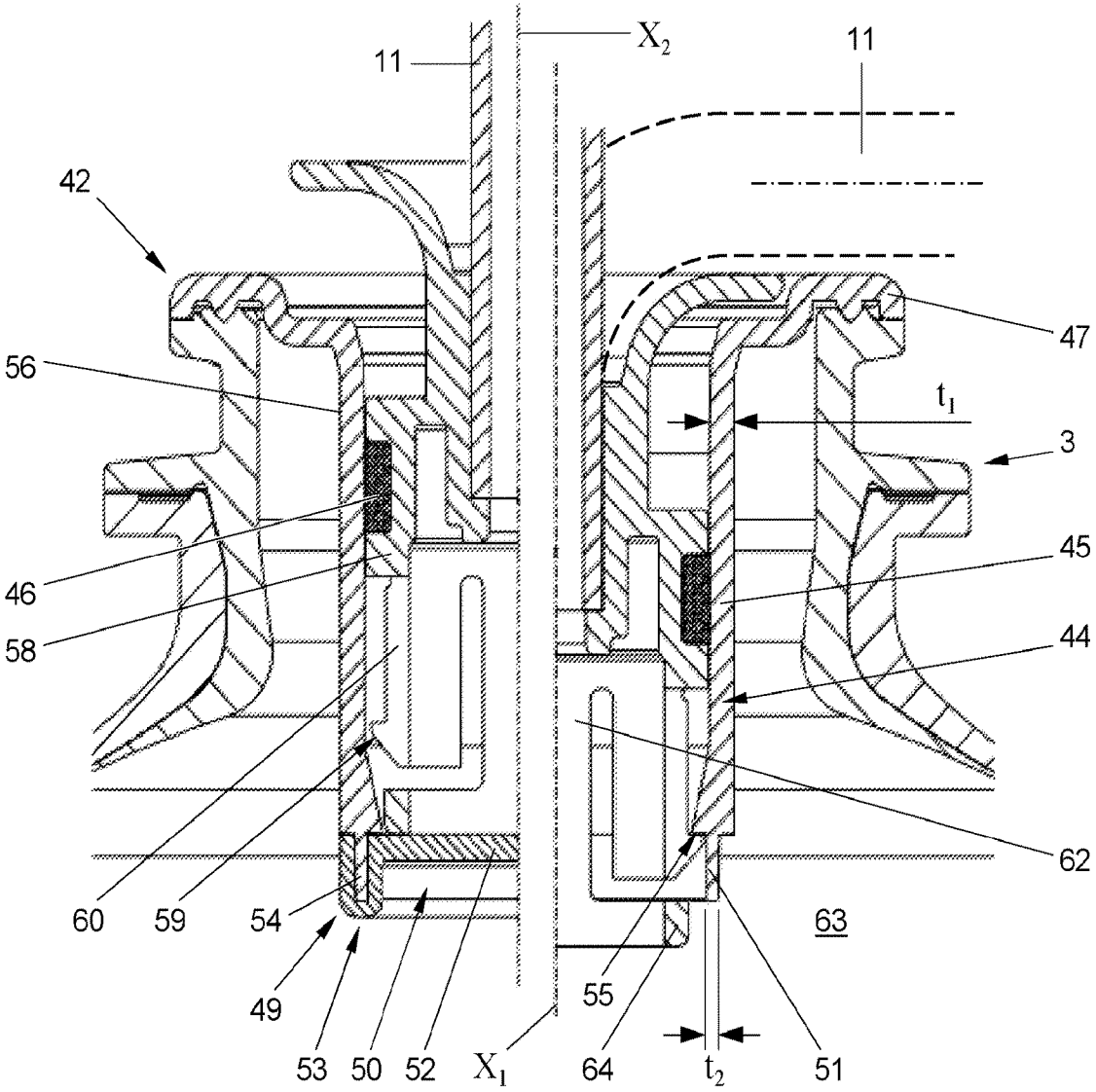
Figure 6B:
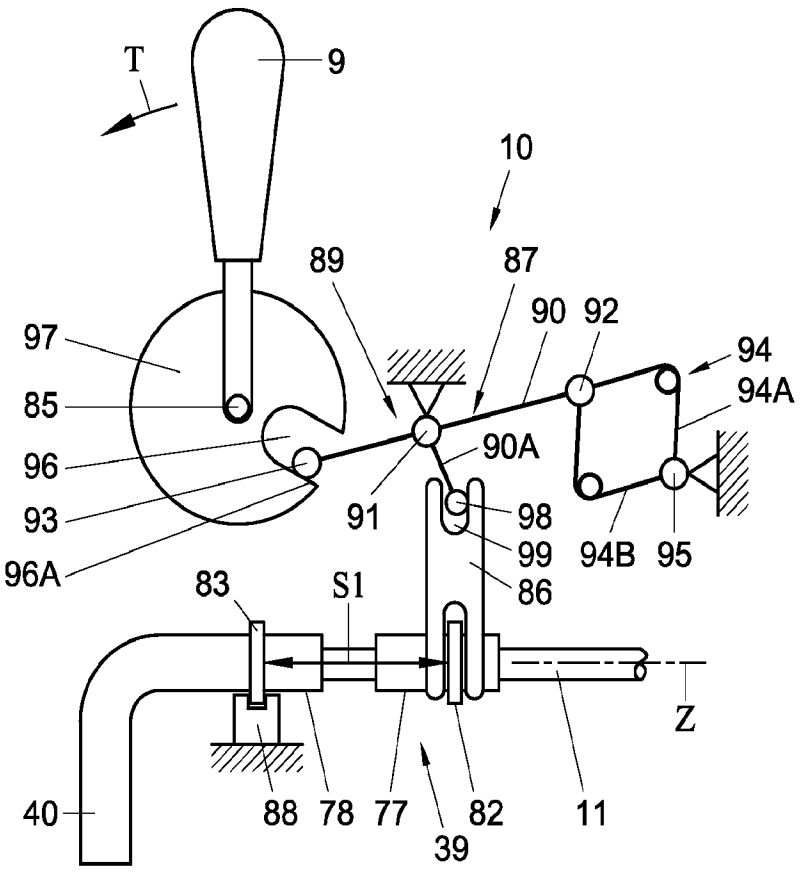
Figure 6A:
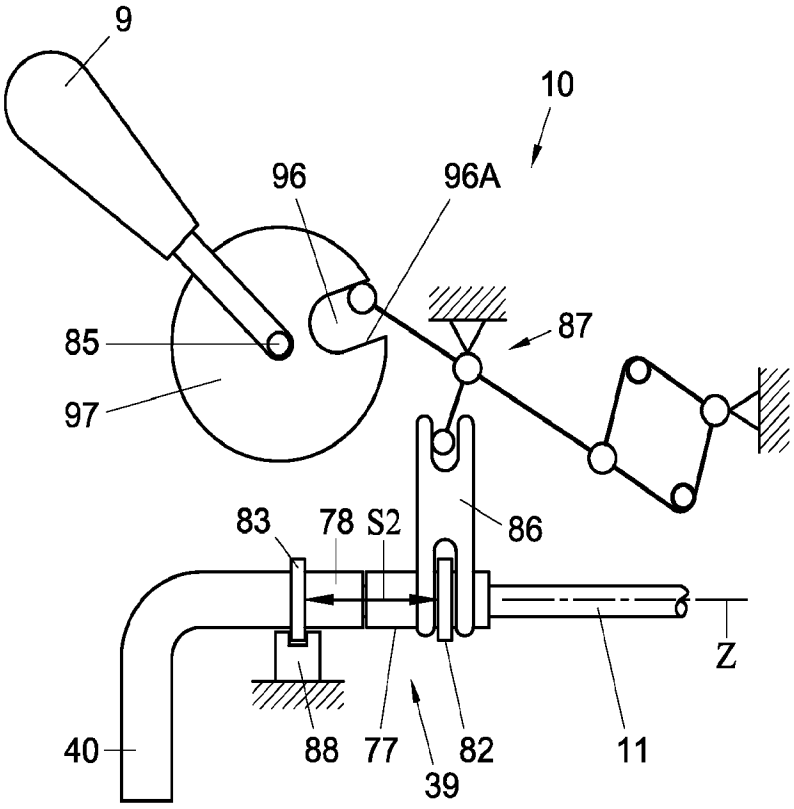
Figure 8:
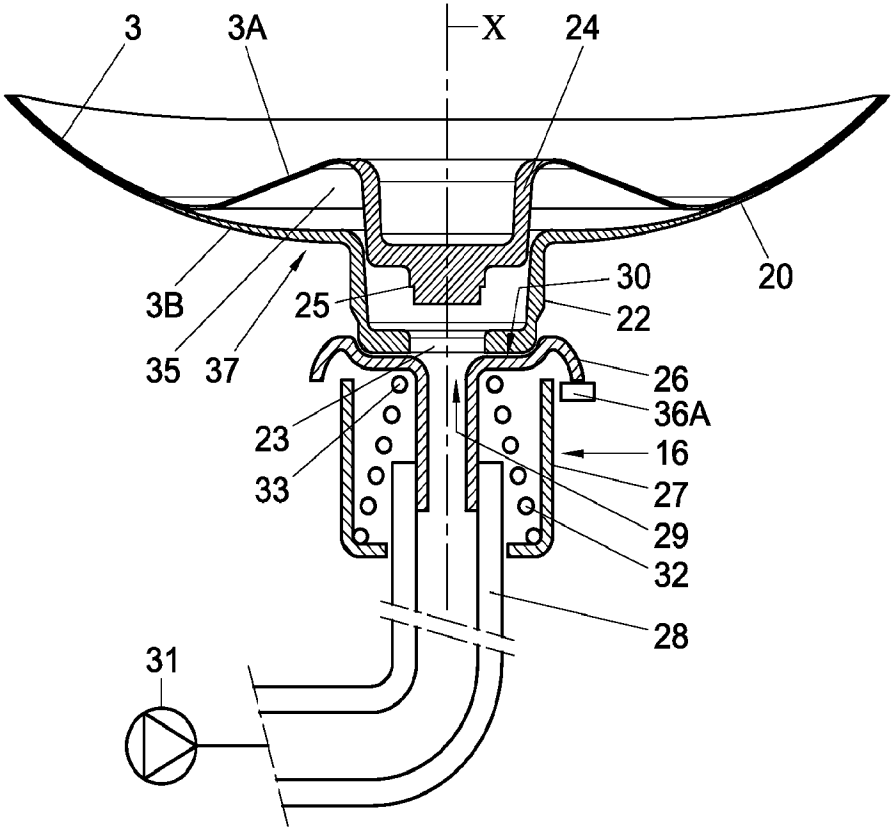
Figure 7:
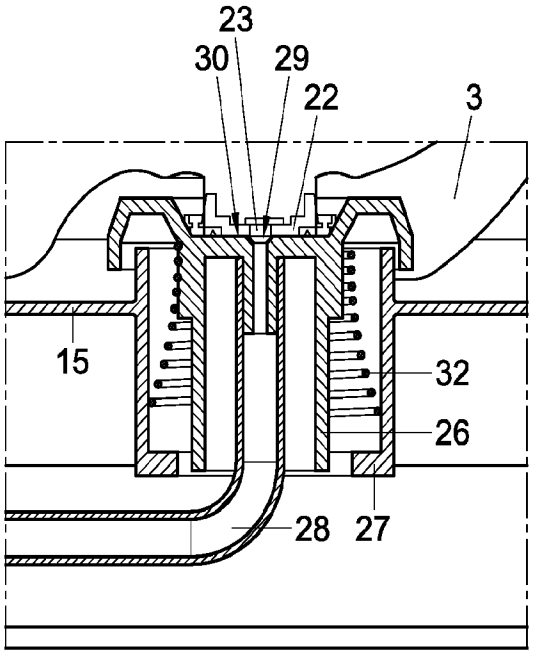
Figure 9B:
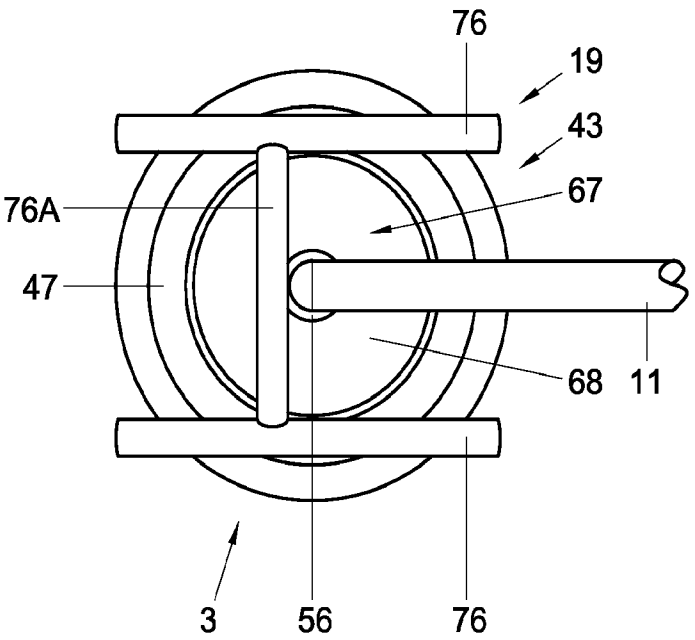
Figure 9A:
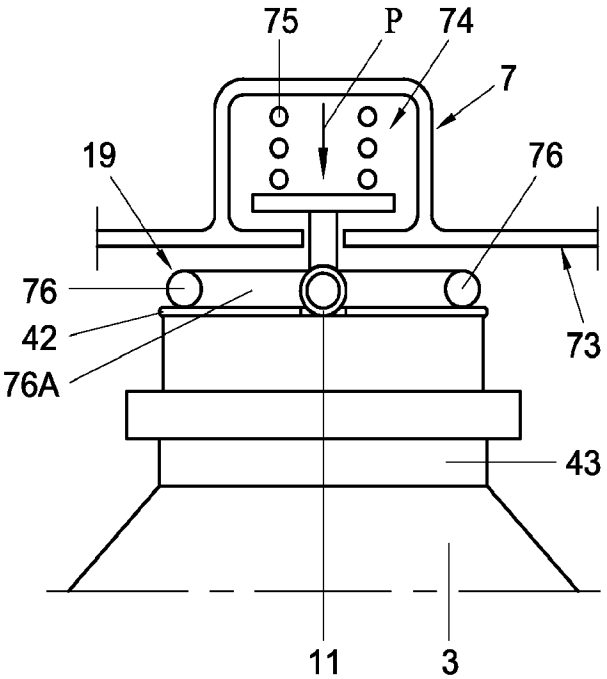
Figure 10:
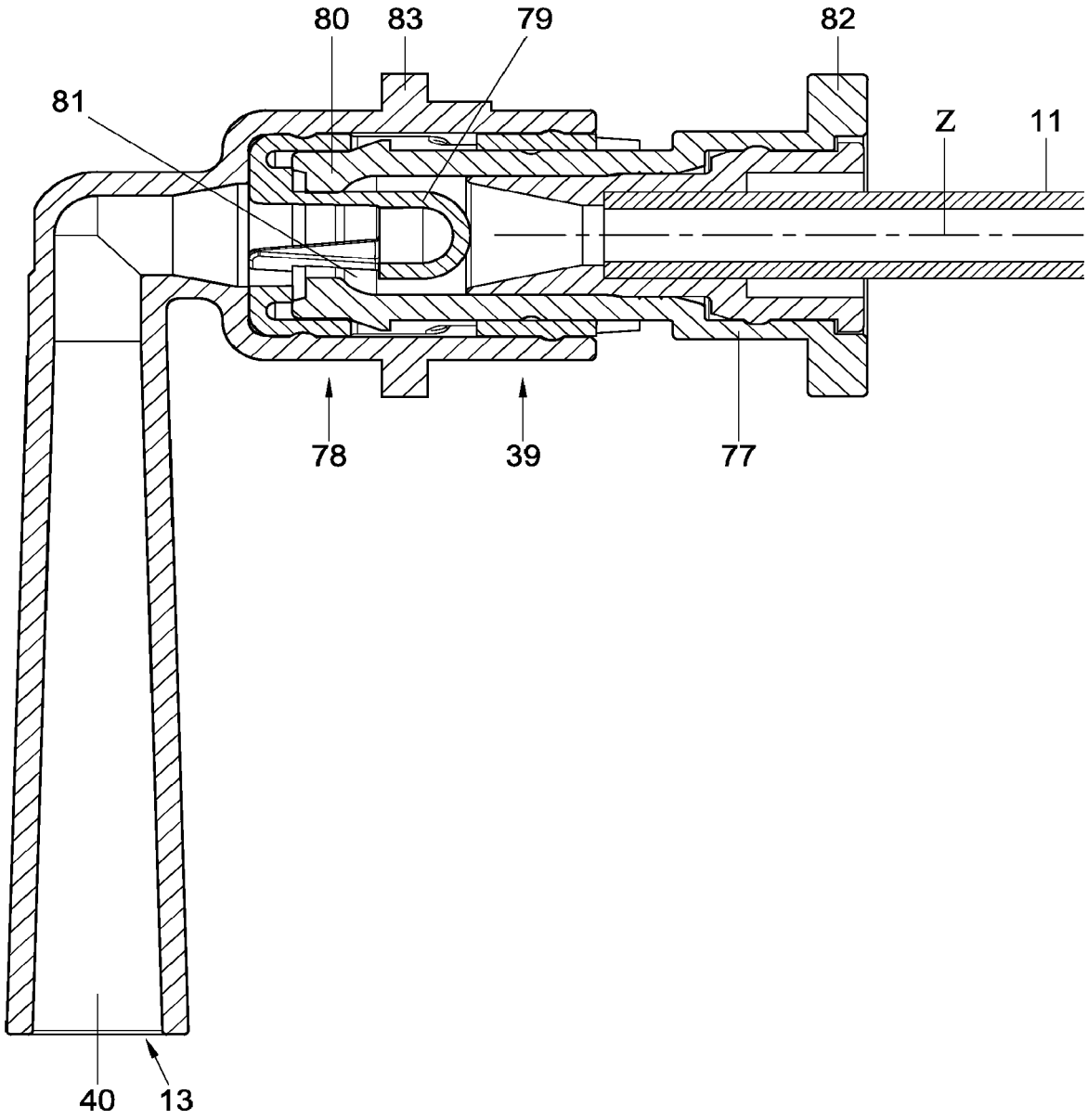

In order to further elucidate the present invention, embodiments thereof shall be disclosed and discussed hereafter, with reference to the drawings. Therein shows:

FIGS. 1A and B schematically in top and side view respectively an assembly according to the disclosure, with a container enclosed inside the tapping assembly;

FIG. 2 schematically in cross sectional view along the line II-II in FIG. 1 an assembly according to the disclosure;

FIG. 3 schematically an assembly of FIGS. 1 and 2, with a tapping apparatus in open position and a container for insertion therein, showing an operating element with tapping line;

FIG. 4 schematically in cross sectional view a neck region of a container with a closure, prior to opening the container;

FIG. 5 schematically in cross section view the neck region as shown in FIG. 4, wherein at a left side the closed position and at a right side the open position is shown;

FIGS. 6A and B schematically a valve operating system for use in a tapping assembly, showing a bi-stable spring operated assembly, with the valve open and closed respectively;

FIG. 7 schematically a detail of a connection between a container and the tapping apparatus, especially an pressurised gas supply;

FIG. 8 schematically a bottom part of a container and a first connector for supplying pressurised gas;

FIGS. 9A and B schematically in side and top view a pressure element over an end of the container; and FIG. 10 schematically in cross sectional view an embodiment of an in-line valve.

In this description embodiments are shown and disclosed of the invention, by way of example only. These should by no means be interpreted or understood as limiting the scope of the present invention in any way. In this description the same or similar elements are indicated by the same or similar reference signs. In this description embodiments of the present invention shall be discussed with reference to carbonated beverages, especially beer. However, other beverages could also be used in the present invention.

In this description references to above and below, top and bottom and the like shall be considered, unless specifically stipulated differently, to an orientation of a container lying down on a side, as for example shown in FIG. 2. This does not necessarily reflect the orientation in which a tapping device of the present disclosure or parts thereof have to be used.

In this description a bag-in-container type container, such as a bag-in container (BIC) or Bottle in Bottle or Bag in Bottle (BIB) type has to be understood as meaning at least a container comprising an outer holder and an inner holder, wherein the inner holder is designed to hold a beverage and is more flexible or compressible than the outer holder. The outer holder can for example be a container, such as a bottle shaped container with a neck and a body, a box shaped holder or the like, whereas the inner holder can be a flexible container, such as a bag. The inner and/or outer holder can be made of mono materials or blends, can be made entirely or partly by injection moulding and/or blow moulding, rotation moulding or the like. Preferably a bag-in-container according to the invention is made by integrally blow moulding. In embodiments the bag-in-container can be made by inserting at least one preform into another preform and then blow moulding them together into a bag-in-container type container. In embodiments the bag-in-container can be made by over-moulding at least one preform forming a multi layered preform and then blow moulding them together into a bag-in-container type container. In embodiments a bag can be suspended inside an outer container, after forming the outer container and the bag separately, at least in part.

In the present disclosure by way of example a bag in container (BIC) shall be described, integrally blow moulded from a preform set comprising two plastic preforms, super imposed, which should be understood as meaning that one of the preforms is inserted into the other, after which they are together blow moulded in a known manner into a BIC.

In this description a tapping assembly shall be described, comprising at least a tapping apparatus and a container, especially a bag in container (BIC) type container and a valve operating device or such device to which the container is to be coupled, as well as a source of pressurised gas, such as air. As pressure fluidum other gasses can however be used, such as $CO_2$, or another fluidum, such as water. The fluidum can be supplied in any suitable way, as is known in the art, but is preferably provided as pressurised air by a pump or compressor incorporated in the tapping device.

In this description wording like substantially, about and the like should be understood as meaning that variations are possible with respect to the property it refers to, for example deviations of 15% or less, such as 10% or less or 5% or less or for example 30° or less, such as for example 20° or less, such as 10° or less.

FIG. 1 shows schematically a beverage dispensing assembly 1, comprising a tapping apparatus 2 with a container 3 (not shown in FIG. 1) enclosed therein. In FIG. 2 a cross sectional view of such assembly 1 is shown, whereas in FIG. 3 the assembly is shown, broken down in different elements thereof, as will be discussed hereafter. The container 3 can be a BIC or BIB type container comprising an inner and outer container 3A, B (see also FIG. 4, 5, 7, 8), connected to each other a least at a neck region N and possibly also at a position spaced apart from the neck region N, in order to even better prevent the inner container to collapse in a manner that dispensing of beverage can be blocked. As can be seen in for example FIGS. 2 and 3 the container 3 can be positioned inside the tapping apparatus 2 in a lying position, in which the longitudinal axis X of the container 3 extends substantially horizontally when the tapping apparatus is in a normal position of use, as shown in FIG. 1 B. In other embodiments the position of the container 3 could be different, for example having the longitudinal axis X extending substantially vertically, or angled relative to both horizontal and vertical planes. Having the axis X extend substantially horizontally may have the advantage that the overall height H of the apparatus above a surface S on which it is positioned can be limited, when the overall length L of the container, measured along the longitudinal axis X is larger than the maximum diameter W of the container 3. Moreover, this may enable a positioning of an insertion opening 6 of the apparatus 2 at a front position, obviating the need of providing additional space above the apparatus 2 for opening the apparatus and placing the container, and obviating the need of lifting the container to a position above the apparatus for loading it into or removing it from the apparatus.

The tapping apparatus 2, shown in FIGS. 1 and 2 in closed position, comprises a housing 4 enclosing a chamber 5 (FIG. 2) having an opening 6 closable by a lid 7. The lid 7 can be removable from the further housing 4 or can for example be pivotable and/or slidable relative to the further housing 4. In the embodiment as shown in FIG. 3 the lid 7 is pivotable around an axis 8 mounted at a top side of the opening 6. Other positions of such axis 8 are obviously possible. When the lid is slidable relative to the further housing, the lid could be made drawer shaped, such that the container can be placed in or on such drawer and slid into the chamber 5 by closing the lid 7.

In the embodiment shown in FIGS. 1-3 above the opening 6 a tapping handle 9 is shown, as part of a tapping valve operating system 10 as will be discussed further on. A dispense line 11 of the container 3 may be connected to the tapping valve operating system, for opening and closing a passage through said dispense line 11, such that beverage can be dispensed or dispensing thereof can be prevented or terminated.

A drip tray 12 is shown below a beverage outlet opening 13. At a rear of the apparatus schematically a mains plug 14 is shown for connecting the apparatus to a mains for supplying electricity to for example electronics of the apparatus, to a compressor or pump and to cooling elements in the apparatus 2, all in a manner known per se.

FIG. 2 shows schematically and in cross sectional view the container 3 placed within the chamber 5, enclosed between the lid 7 and an opposite end 15 of the chamber 5. Spaced apart from the lid 7 a first connector 16 is provided, for feeding pressurised gas into the container 3 through a gas inlet 17 provided in the container 3. At the side 18 of the opening 6 of the chamber 5 a pressure element 19 is provided for pressing the container 3 with the gas inlet 17 onto the first connector 16. Preferably the first connector 16 is provided at the opposite end 15 of the chamber 5, whereas the gas inlet 17 is preferably provided centrally at the bottom 20 of the container 3, at the longitudinal axis X thereof.

In embodiments the container 3 can be a BIC type container, and in embodiments the air inlet 16 can comprise a valve 21, for example as schematically shown in FIG. 8 for allowing gas to enter into the container 3. In this embodiment the container 3 comprises a flexible inner container 3A and a more rigid outer container 3B. At the bottom portion 37 of the outer container 3B a first element 22 is formed, preferably integrally, having a central opening 23, which element 22 may have a bulge or cup shape. The inner container 3A is also provided at the bottom with a similar element 24, which can fit snugly within the element 22, over the opening 23. The element 24 may have a protrusion 25 which can enter into the opening 23. In an embodiment not shown the protrusion 25 may extend through the opening 23 and can be provided with a widening outside the opening 23, such that the element 24 has a limited path of travel in the longitudinal direction of the axis X.

The first connector 16 can comprise a connecting part 26 movable relative to a housing 27, which connecting part is connected to a gas supply line 28. The gas supply line 28 may be flexible, such as to accommodate for movement of the connecting part 26. The connecting part has an opening 29 in a surface 30 that can sealingly engage the first element 22 around the opening 23. such that a gas tight connection can be obtained between said two openings 23, 29. The gas supply line may be connected to an air pump or compressor 31 within the tapping apparatus, for supplying pressurised gas, especially air through said openings 23, 29. A spring element 32 is provided between the connecting part 26 and the housing 27, biasing the connecting part 26 towards the container 3 and allowing adjustment of the position of the connecting part 26 relative to the housing 27 and/or to the container 3. In the embodiment shown the spring element 32 comprises or is formed by a conically wound, helical spring, forming a frusto-conical shape having the top 33 engaging the connecting part 26 around the opening 29. The outer surface 30 of the connecting part 26 is preferably slightly hollow such that it can be self centering relative to the first element 22, in order to properly align the openings 23, 29. The spring, especially the conical spring will allow for longitudinal adjustment, radial adjustment and angular adjustment of the position of the connecting part 26 and especially the outer surface 30 thereof relative to the container 3.

In the embodiment shown the chamber 5 is provided with a lower or bottom side 34, on which the container can be positioned and over which the container 3 can be slid form the opening 6 towards the opposite end 15 thereof. The positioning of the first connector 16 is preferably such above the bottom side 34 that the distance D between the bottom side 34 and the opening 29 of the connecting part 26 is about half the diameter W of the container, such that the opening 29 will align with the opening 23 on the longitudinal axis X of the container. The bottom side 34 can be concave in cross section, such that the position of the container 3 relative to the chamber is thereby thus defined. By providing the movable and preferably self positioning connecting part 26 adjustments of the position of the opening 29 can be obtained for adjusting for for example production tolerances, changes in the diameter W and/or longitudinal length L of the container 3, which could be due to for example temperature or pressure changes within the container 3 or the like or askewness of one or both of the surface 30 and the element 22. An additional advantage of such relatively close fitting bottom part 34 of the chamber 5 is that cooling of the container 3 through contact cooling can be obtained very efficiently, by cooling the bottom part 34 of the chamber with cooling means 34A.

When pressurised gas such as air is forced through the opening 29 it will push the second element 24 away from the opening 23, allowing the gas to flow into the space 35 between the inner container 3A and the outer container 3B, thus compressing the inner container 3A. The inner container 3A can be connected to the outer container 3B, for example at to spaced apart locations, such as for example at opposite axial ends at or near the neck region and at or near the connector 7, such that a direction of compression may at least partly be predefined, such as primarily in radial direction. When the pressure in said space 35 is about equal to or slightly higher than a desired pressure for the beverage, the supply of gas may be stopped. To this end in a known manner the electronics 36 of the apparatus may comprise a pressure sensor and switching means for switching on and off the pump or compressor 31 depending on the pressure in the container relative to a desired set pressure, for example by measuring the pressure in the line 28. When the container is removed from the apparatus the second element 24 may be pushed back over and/or into the opening 23 closing the opening 23 and thus acting as a valve 21.

As shown and discussed before the container 3 can be slid into position in the chamber 5 within the apparatus 2 by inserting it into the chamber through the opening 6, bottom 37 forward, until the first element 22 is pushed against the connecting part 26. Then the lid 7 can be closed over the container 3, locking it into position and forcing the connecting between the openings 23, 29. In embodiments a switch can be provided at or near the first connector, for allowing supply of electrical power to the pump or compressor 31 once the connecting part 26 is moved relative to the housing 25 over a predetermined distance, thereby indicating that a container has been properly placed. Alternatively such movement can open a valve in the pressurised gas supply line 28. Such embodiments may prevent accidental introduction of pressurised gas into an empty chamber 5 or when a container is not (yet) properly placed. Also other sensors can be applied for sensing whether a container is present and properly placed in the chamber 5 before allowing pressurising air.

Before closing the lid 7 over the opening 6 the dispense line 11 can be connected to the container 3 and the tapping valve operating system 10, operable by the handle 9. This can be done prior to closing the lid 7 or by closing the lid 7 or after closure, when pressurizing the container. In FIG. 3 schematically the dispense line 11 is shown, comprising at one end 38 an inline valve 39 with a dispense tube 40, and at the opposite end connected to an operating element 41 for cooperation with a closure 42 of the container 3, which is shown in FIGS. 4 and 5 in more detail. In embodiments the operating element 41 and dispense line 11 can be delivered to a customer or other user separately or at least in non-assembled state, such that accidental opening of the closure is easily prevented. Moreover the closure can then be sealed with a seal 100, for example a foil or cap, preventing contamination and acting as a pilfer proof. Furthermore this can have the advantage that the container can be packed and stored more compact.

The container 3 and/or the operating element 41 with the dispense tube 11 and in-line valve can be disposable, made substantially of plastics materials and/or for single use only. The in-line vale could be omitted and for example be replaced with a flexible tube part, squeezable by the vale operating system 10 for opening and closing the passage for dispensing beverage, as for example known from WO2006/082486, or the tapping line 11 could, at the end 38, be provided with a coupler for coupling to a tapping cock, for example quick coupler as known in the art. Preferably the in-line vale 39 is used, for example as disclosed in U.S. Pat. No. 7,390,375, US2004/0226967 and NL1015368. In FIG. 10 schematically an embodiment of such valve 39 is shown, in cross section, as will be discussed further on.

As shown in FIGS. 4 and 5 the closure 42 is provided at or in the neck region 43 of the container 3. The closure 42 is here described in the context of the also disclosed tapping apparatus container and/or method. However this closure 42 or a similar one can also be used with other containers, methods and/or apparatus. The closure 42 can comprise a substantially tubular element 44 extending into the neck region 43, inside the container, especially inside an inner container of a BIC. The tubular element 44 has a longitudinal axis $X_1$, preferably substantially parallel to and more preferably coinciding with the longitudinal axis X of the container. The tubular element 44 has a closed peripheral wall 45, preferably with a substantially constant circular inner cross section. The tubular element 44 is connected to a flange 47 at a first end 48, which flange 47 is connected to the neck region 43 of the container 3 for supporting the tubular element 44 in the neck region 43. The flange 47 may be connected to the container in any suitable manner. The flange 47 may be connected for example by bonding, welding, gluing, press fitting, screwing, snapping or any such technique. Preferably the connection is irreversible.

At a second end 49 opposite the first end 48 the tubular element 44 may closed by a cap 50. The cap 50 may be made of plastic or rubber. In the embodiment shown the tubular element 44 at the second end 49 comprises a peripheral rim portion 51. The cap 50 comprises a central part 52 and a rim portion 53 extending around it, which rim portion 53 comprises a groove 54 that fits snugly over the rim portion 51 of the tubular element 44. The rim portion 51 may have a thickness $t_2$ smaller than the thickness $t_1$ of the further tubular element 44, which may increase at the end 49 slightly further, such that a shoulder 55 is formed at the second end 49 of the tubular element 44, at the inward facing side of the rim portion 51. The cap 50 can be made separate from the further closure 42 and fixed to the end 49 for closing the tubular element 44. Preferably the closure 42 is made integrally, for example by multi-component injection moulding, such as 2-K moulding. Preferably the cap 50 and tubular element 44 are made of such materials that during manufacturing the cap 50 is crimped onto the rim portion 51. In use the cap 50 may be pressed further onto the rim portion 51 for further closure.

The operating element 41 fits inside said tubular element 44, from the first end 48. The operating element comprises a body 56 with a central channel 57 extending longitudinally through the body 56. From a first end 66 of the body 56 the dispensing line 11 is fitted into the channel 57. It may be press fit in the body 56 or otherwise connected, for example bonded or welded or mounted by for example use a clamping means, as known in the art for mounting flexible tubing. The portion of the dispense line 11 inside the channel 50 has an axis parallel to and preferably coinciding with the longitudinal axis $X_2$ of the channel 57. From the opposite end 58 of the body 56 the operating element 44 comprises an end portion 59 provided with axially extending elements 60. These elements 60 can for example be click fingers. The elements 60 have outward facing portions 61 for engaging the second end 49 of the tubular element 44, especially under the shoulder 55, when the cap 50 is removed at least in part from the tubular element 44, as will be discussed further. These elements 60, 61 may lock the operating element 41 within the tubular element 44. Between the locking elements 60 spokes 62 can be provided, which are connected at one side to the body 56 and at the opposite end, facing the inner volume 63 of the container 3, a ring 64 is provided, extending longitudinally passed the locking elements 60.

At the first end 66 of the body 56 an outward flaring flange 67 is provided around the dispense line 11, widening in a direction away from the body 56. The inward facing surface 68 of the flange 67 is preferably convex and the flange is rotation symmetrical around the axis $X_2$. Therefore the flexible dispense tube 11 can be bent along the surface 68 in any direction over a substantial angle, for example 45 degrees or more or, preferably, at least about 90 degrees, without buckling or pressed shut or otherwise being blocked.

The operating element 41 has, at an outer surface of the body 56, a peripheral seal 46 for slidingly sealing against the inside of said wall 45. The cap 50 is fitted at or near the end of the tubular element 44, closing off the tubular element 44. The operating element can be pushed into the tubular element 44 to such extend that it at least partly removes the cap 50 from the tubular element 44, for opening a passage from the container to the tapping line 11 connected to the operating element 41. When pushing down the operating element 41 into the tubular element 44 the forward second end, and especially the ring 64, if provided, will be forced against the cap 50, such that when pushed further, the cap 51 will be forced at least partly from the rim 51, allowing the elements 61 to click under the shoulder 55. The cap 50 may be entirely removed, which means that it will fall into the beverage space 63. Alternatively the cap may maintain attached to part of the tubular element, for example by a living hinge, still allowing the elements 61 to hook under the shoulder or at least open a passage from the space 63 to the dispense line 11 through the operating element. The ring 64 and elements 61 will prevent the cap 50 from reclosing the end of the tubular member 44.

In the embodiment shown, the length $L_{tube}$ of the inside tubular member, measured along the axis $X_1$ is larger that the distance $L_{end}$ between the ring 64 and the seal 46, such that when the operating element 41 is inserted into the tubular element, the seal 46 will first sealingly engage the surface 45 before the cap 50 can be pushed off at least part of the tubular element, especially off the rim 51. Thus spilling of beverage is prevented passed the operating element 41.

In the outward facing surface 69 of the flange 47 a stepped surface portion 70 for receiving part of the flange 67, such that the upper edge 71 of said flange 67 will come to lie about flush with or below the higher portion 72 of the flange 47.

As can be seen in FIGS. 9A and B the pressure element 19 can press against the container 3 at the neck region 43, especially against the flange 47 for pushing the container 3 towards the end 15 of the chamber 5. In this embodiment the element 19 is mounted on an inward surface 73 of the lid 7, by a resilient suspension 74, which can for example comprise a spring 75 pushing the element 19 in a direction P away from said surface 73. In this embodiment the element 19 comprises a substantially H-shaped configuration with two rods 76 extending substantially parallel to each other in spaced apart relationship, such that they can be positioned at opposite sides of the dispense line 11, connected through a cross bar 76A. The rods are long enough to rest on the flange 47 and preferably extend slightly further. In the embodiment shown the rods also cover part of the flange 67, thus ensuring that the operating element 41 is maintained in position, even if the locking elements 60, 61 would fail. In the embodiment shown the rods will in use extend substantially vertically. It shall be clear that the element 19 can have different shapes, dimensions and configurations, as long as it can push the container towards the end 15, without squeezing the dispense line 11. It can for example be substantially U-shaped, C-shaped or the like in the view as shown in FIG. 9B.

FIG. 10 shows schematically an embodiment of an in-line valve 39 with a dispense tube 40, which in this embodiment is bent down relative to a longitudinal axis Z of the valve 39. In this embodiment the tube 40 widens towards the outlet end 13 for better flow characteristics for carbonated beverages, especially beer. The valve 39 comprises a first part 77, part of connected to the dispense line 11 in any suitable way, and a second part 78 connected to or part of the tube 40 and snapped over an end of the first part 77. Within the second part 78 a valve body 79 is provided over which a closure end 80 of the first part 77 fits. The first and second parts 77, 78 are movable relative to each other in the longitudinal direction Z for opening and closing the valve 39. In FIG. 10 the valve 39 is shown in open position. The closure end 80 has been passed over the valve body 79 and provides for a fluidum connection between the dispense line 11 and the tube 40 through at least one slit 81 in the valve body 79. When in FIG. 10 the first and second parts 77, 78 are pulled further apart, the closure end 80 of the first part 77 will be pulled passed the slit or slits 81, and close said fluidum connection. For a further understanding of this in-line valve type of valve and alternatives thereof reference is made to for example U.S. Pat. No. 7,390,375, US2004/0226967 and NL1015368 and Heineken's BeerTender® and David® tapping systems.

As can be seen in FIG. 10 the first and second parts 77, 78 comprise flanges 82, 83 respectively, for engaging these parts 77, 78 by the operating system 10. In such embodiment the handle 9 can be connected, via a pivot or pivot mechanism 85, to one of these flanges 82, 83, the other flange being locked in a fixed position within the support 84 of the tapping handle 9 and/or pivot mechanism 85 thereof. The pivot mechanism can be such that a pivoting of the handle leads to a translation of the one part 77 relative to the other part 78, thus opening and closing the valve 39.

In an embodiment of FIG. 6 an example is shown of the valve operating system 10 comprising a tapping handle 9 and a valve engagement portion 86 engaging the valve 39 connected to or provided in said dispensing line 11. Between the tapping handle 9 and said valve engagement portion 86 a bi-stable spring operated assembly 87 is provided, such that upon movement of the handle 9 over a predetermined angle from a rest position the spring operated assembly 87 switches from a first stable position into a second stable position, forcing the engagement portion 86 from a position fully closing the valve 39, as shown in FIG. 6B into a position fully opening the valve 39, as shown in FIG. 6A, preferably substantially irrespective of movement of the handle further away from the rest position, or vice versa. The rest position is hereby to be understood as the position of the handle 9 when released and with the valve 39 closed. In this embodiment the first part 77 of the valve 39 is engaged by the engagement portion 86, whereas the second part 78 is held in a position by a holder 88 in the tapping apparatus 2. An arm 89 is provided having a first leg 90 mounted in a pivot 91 between opposite first and second ends 92, 93, and a second leg 90A extending from near said pivot at an angle, for example about perpendicular to the first leg 90. The arm 89 is thus substantially T-shaped. The first end 92 of the arm 89 is connected to a spring 94, which is mounted to a fixed point 95 in the apparatus 2. In the embodiment shown the spring comprises two spring elements 94A, 94B, bent in opposite directions and together forming a substantially square spring element 94. The position of the point 95, the pivot 91 and the holder 88 is preferably fixed relative to each other and to the apparatus 2. The opposite second end 93 of the first leg 90 extends into a cut out 96 in a disk 97 connected to the handle 9 and pivotable around a pivot 85. The cut out 96 is significantly larger than the size of the second end 93, such that upon pivoting of the arm 89 around the pivot 91 the second end 93 can move within the cut out 96 without moving the disk 97. The free end 98 of the second leg 90A extends into a slit 99 in the engagement portion 86 which encloses the flange 82 on the second part 78 of the valve 39. The engagement portion 86 is movable in the axial direction Z of the valve 39.

In FIG. 6B the valve 39 is shown in a closed position, the distance $S_1$ between the flanges 82, 83 being minimal. The second end 93 of the first leg 90 lies at a lower side 96A of the cut out 96 in the disk 97, the first end 92 having been moved to a position above the point 95. The handle 9 extends up. If from this position the handle 9 is moved, that is the disk 97 is rotated around the pivot 85, in the direction of the arrow T in FIG. 6B, towards the position as shown in FIG. 6A, the said lower side 96A of the cut out 96 will push the second end 93 of the first leg 90 upward, pivoting the arm 89 around the pivot 91. This will compress the spring elements 94A, B until the first leg 90 is brought into a position in which the first 92 and second ends 93 are aligned with the point 95. Then even the slightest rotation of the arm 89 further in the same direction will provide for a force on the first end 92 in downward direction by the spring 94. The second end 93 can thereby freely move up through the cut out 96 over a relatively large distance. The free end 98 of the second leg 90A can first move within the slit 99 from a position in which it engages a first side 99A of the slit 99 to a position engaging the opposite second side 99B of the slit 99, without moving the first part 77 of the valve 39. Thereafter the end 98 of the second leg 90A will push the first part 77 towards the second part 78, opening the valve 39, bringing the flanges to a smaller distance $S_2$. Since the arm 89 can freely pivot in said direction, preferably over the angle required for that movement, due to the freedom of movement of the second end 93 within the cut out 96, this will be automatically be achieved, substantially or entirely without influence of the position of the disk 97, once the disk has passed the position in which it has pushed the arm passed the mid position in which the first 92 and second ends 93 are aligned with the point 95.

Preferably the end 98 will engage the second side 99B of the slit 99 only when the arm 89 is brought into about the position in which the first 92 and second ends 93 are aligned with the point 95, such that prior to that position the valve elements 77, 78 are not moved over any relevant distance.

For closing the valve again the opposite direction of movement will occur, again forcefully closing the valve once the disk 97 has been rotated beyond a position in which the first 92 and second ends 93 are aligned with the point 95.

Such tapping valve operating system 10 has the advantage that it mechanically provides for a tapping system in which it is virtually impossible to open the valve only partly, or close it only partly. This will improve tapping behaviour, especially for not so experienced users. It further increases convenience.

A tapping assembly of the present invention can be used as follows.

A container 3 is obtained by or otherwise provided to a user, together with the operating element 41 with dispense tube 11 and valve 39. The user removes a seal 100 or other provision covering the closure 42 and pushes the operating element 41 into the tubular element 44 of the closure, all the way down, thus pushing the cap 50 from at least part of the tubular element 44 and opening the container. The valve 39 is preferably in a normally closed position, such that no beverage can be released from the container. Then the lid 7 of the apparatus 2 is opened and the container 3 is slid into position within the chamber 5. The dispense line 11 is bent upward, such that the valve 39 can be positioned in the valve operating system. Especially one of the flanges 82, 83 is engaged by the holder 88 and the other by the valve engagement element 86, operable by the operating system 10. Then the lid 7 is closed over the container, pushing the pressing element 19 against the container 3, especially against the neck thereof, as disclosed, forcing the connectors 16, 17 in fluid communication. The length of the dispense line 11 is preferably such that the dispense line 11 is pulled along the surface 68 of the flange 67 when the valve 39 is properly positioned in the holder 88. This prevents the tube 11 form being engaged by the element 19. When power to the compressor or pump 31 switched on pressurised air will be forced into the space 35, pressurising the beverage inside the inner container 3A. When then the valve 39 is opened, beverage will be dispensed until the valve 39 is closed again.

After a desired amount, possibly substantially all of the beverage has been dispensed form the container 3, the lid 7 may be opened again and the container 3 can be pulled out of the chamber 5 and can be either stored for further use, if not empty, or can be discarded. The container 3 can be replaced by another container 3 easily. Since the valve 39 and dispense line 11 are replaced too, contact between the beverage and the apparatus 2 can be minimised, if not prevented, thereby reducing the need of cleaning the apparatus to a minimum.

The invention is by no means limited to the embodiments specifically disclosed and discussed here above. Many variations thereof are possible, including but not limited to combinations of parts of embodiments shown and described. For example the container can be a single walled container in stead of a BIC or BIB type, or can be a membrane container, in which a membrane separates a beverage compartment connected to the neck from a pressurising compartment positioned in connection with the connecting element 17. The tapping device can be provided with the opening 6 and lid 7 in a different position, for example at a top side of the apparatus, wherein the opposite end 15 can be the lower end of the chamber. The opening 6 could be at the front of the apparatus, wherein the container could be positioned with the axis X vertically, directly on top of the connector 16. In embodiments the lid could be at least in part an integral part of the container and/or operating element. In embodiments the first connector could be positioned differently, for example at or in the lid, wherein a container can be inserted into the chamber such that the neck region, or at least the dispense opening of the container faces away from the lid, for example towards a bottom of the chamber, whereas the gas inlet of the container faces the lid. The pressure element can then be provided at said end of the chamber opposite the lid, for example the bottom of the chamber. A dispense line 11 can then extend for example alongside the container towards the lid or a tap or be guided out of the chamber in any other suitable way. Alternatively the apparatus could be open, such that the container is placed on for example an air supply directly. Cooling can be obtained in any suitable way, including but not limited to contact cooling, cooling of the air in the chamber, or any other such suitable means. The tapping valve operating system could be designed differently, for example for directly engaging the valve or for squeezing the dispense line, as a tube valve, when no in-line valve is used. The closure could be formed differently, for example comprising a valve in stead of the cap, and the operating element could be designed differently, for example such that it can be screwed or otherwise positively connected to the tubular element for obtaining a fluid tight connection. The operating element can be designed to pierce the cap in stead of pushing the cap away from at least part of the tubular element.

These any many other variations are considered to fall within the scope of the present invention.

The invention claimed is:

1. A beverage container, wherein a closure is provided in and/or on a neck region of the beverage container, comprising a substantially tubular element at the neck region, having a peripheral wall, and an operating element fit inside said substantially tubular element, slidingly sealing against the peripheral wall, wherein a cap is fitted at or near an end of the substantially tubular element, closing off the substantially tubular element, wherein the operating element can be pushed into the substantially tubular element to such extent that the operating element at least partly removes the cap from the substantially tubular element, pushing the cap at least partly into a beverage space of the container, away from the substantially tubular element, and/or pierces said cap, for opening a passage from the beverage container to a tapping line connected to the operating element.

2. The beverage container according to claim 1, wherein the tubular element with the cap has been manufactured by multi-component moulding.

3. The beverage container according to claim 1, wherein the beverage container is a bag-in-bottle- or bag-in-container-type container.

4. The beverage container according to claim 1, further comprising a gas inlet at a bottom end of the beverage container, opposite the neck region of the beverage container.

5. The beverage container according to claim 4, wherein the gas inlet provides a gas connection between an inner volume of the container and a pressurised gas supply.

6. The beverage container according to claim 4, wherein the gas inlet opens into a pressure space within the beverage container between an inner holder and an outer holder.

7. The beverage container according to claim 4, further comprising a first connector for feeding pressurised gas into the beverage container through the gas inlet.

8. The beverage container according to claim 7, wherein the gas inlet comprises a gas valve operable by pressing the beverage container onto and or into the first connector.

9. The beverage container according to claim 7, further comprising a tapping apparatus comprising a pressure element for pressing the gas inlet onto and/or into the first connector.

10. The beverage container according to claim 9, wherein the pressure element is provided in or on or connected to the lid.

11. The beverage container according to claim 9, the tapping apparatus further comprising a chamber in which the beverage container fits and can be entered into through an opening closable by a lid.

12. The beverage container according to claim 11, wherein the first connector comprises a connecting part movable relative to a housing and connected to a gas supply line, wherein a spring element is provided between the connecting part and the housing, biasing the connecting part towards the beverage container and allowing adjustment of the position of the connecting part relative to the housing and/or to the beverage container and/or to the chamber.

13. The beverage container according to claim 9, wherein the pressure element comprises at least two elements spaced apart, for engaging a neck of the beverage container and/or the substantially tubular element or a flange thereof and/or the operating element, on two spaced apart positions next to a dispensing line.

14. The beverage container according to claim 13, wherein the at least two elements are spaced apart on two spaced apart positions next to the dispensing line at opposite sides of the dispensing line.

15. The beverage container according to claim 1, wherein the operating element comprises a peripheral seal for sealing against said peripheral wall of the substantially tubular element, spaced apart from a forward end facing the cap, such that the peripheral seal engages the peripheral wall of said substantially tubular part in a sealing manner prior to the forward end engaging the cap.

16. The beverage container according to claim 15, wherein a longitudinal distance between said forward end and said peripheral seal is smaller than the longitudinal length between said cap and an opposite end of said substantially tubular part.

17. The beverage container according to claim 1, wherein the operating element comprises an end portion provided with extending elements for engaging the end of the substantially tubular element when the cap is removed at least in part from the substantially tubular element, for locking the operating element within the substantially tubular element, such that the operating element is prevented from moving back again into the tubular element.

18. The beverage container according to claim 17, wherein the extending elements are click fingers.

19. The beverage container according to claim 1, wherein the substantially tubular element is connected to or comprises a flange at a side opposite the end closed by the cap, which flange is connected to the beverage container for supporting the substantially tubular element in the neck region.

20. The beverage container according to claim 1, wherein the operating element comprises or is connected to, at a side opposite a forward end facing the cap, a dispense line, wherein the operating element further is provided at said side with an outward flaring surface surrounding a part of the dispense line, wherein the dispense line is supported by the flaring surface during use.

21. The beverage container according to claim 20, wherein the dispense line can be bent over said flaring surface between a first part extending approximately parallel to a longitudinal axis of the operating element, and a second part extending at about right angles to said longitudinal axis.

22. The beverage container according to claim 20, wherein the flaring surface is designed such that the dispense line can be bent, supported by the flaring surface, over an angle of at least 45 degrees without collapsing.

23. The beverage container according to claim 20, wherein the flaring surface is designed such that the dispense line can be bent, supported by the flaring surface, over an angle of about 90 degrees without collapsing.

24. The beverage container according to claim 20, wherein the dispense line can be bent over the flaring surface between a first part extending approximately collinear with a longitudinal axis of the operating element.

25. The beverage container according to claim 20, further comprising a tapping valve operating system, to which a valve provided in and/or on the dispense line can be connected, such that with the tapping valve operating system a passage of the dispense line can be brought into fluid communication with the environment for dispensing a beverage from the beverage container or blocked there from for interrupting or preventing such dispensing.

26. The beverage container according to claim 25, wherein the tapping valve operating system comprises a tapping handle and a valve engagement portion engaging a valve connected to or provided in the tapping line, wherein between said tapping handle and said valve engagement portion a spring-operated assembly is provided, such that upon movement of the tapping handle over a predetermined angle from a rest position the spring-operated assembly switches from a first-stable position into a second-stable position, forcing the valve engagement portion from a position fully closing the valve into a position fully opening the valve, irrespective of movement of the handle further away from the rest position.

27. The beverage container according to claim 20, wherein the dispense line and the outward flaring surface surrounding the part of the dispense line are adjacent the operating element.

28. The beverage container according to claim 27, wherein the dispense line is at least partly flexible.

29. The beverage container according to claim 1, wherein after said at least partly removal of the cap from the tubular element the passage is open to an inner volume of the container through an end opening of the tubular element from which the cap has been removed at least partly.

30. The beverage container according to claim 1, wherein the cap and tubular element are designed such that after having been removed at least partly from the tubular element the cap is prevented from reclosing said passage.

31. The beverage container according to claim 1, wherein the cap and tubular element are designed such that after having been removed at least in part the cap extends outside the tubular element.

32. A beverage container, wherein a closure is provided in and/or on a neck region of the beverage container, comprising a substantially tubular element at the neck region, having a peripheral wall, and an operating element fit inside said substantially tubular element, slidingly sealing against the peripheral wall, wherein a cap is fitted at or near an end of the substantially tubular element, closing off the substantially tubular element, wherein the operating element can be pushed into the substantially tubular element to such extent that it at least partly removes the cap from the substantially tubular element, pushing the cap at least partly into a beverage space of the container, away from the substantially tubular element, and/or pierces said cap, for opening a passage from the beverage container to a tapping line connected to the operating element, wherein the operating element, at a side opposite a forward end facing the cap, comprises or is connected to a dispense line, wherein the operating element further is provided at said side with an outward flaring surface surrounding a part of the dispense line, wherein the dispense line is supported by the flaring surface.

33. A beverage container, wherein a closure is provided in and/or on a neck region of the beverage container, comprising a substantially tubular element at the neck region, having a closed peripheral wall, and an operating element fit inside said substantially tubular element, slidingly sealing against the peripheral wall, wherein a cap is fitted at or near an end of the substantially tubular element, closing off the substantially tubular element, wherein the operating element can be pushed into the substantially tubular element to such extent that it at least partly removes the cap from the substantially tubular element, pushing the cap at least partly into a beverage space of the container, away from the substantially tubular element, and/or pierces said cap, for opening a passage from the beverage container to a tapping line connected to the operating element, wherein the operating element extends beyond the end of the tubular element after having removed the cap from the tubular element at least partly.

34. A beverage container, wherein a closure is provided in and/or on a neck region of the beverage container, comprising a substantially tubular element at the neck region, having a peripheral wall, and an operating element fit inside said substantially tubular element, slidingly sealing against the peripheral wall, wherein a cap is fitted at or near an end of the substantially tubular element, closing off the substantially tubular element, wherein the operating element can be pushed into the substantially tubular element to such extent that the operating element at least partly removes the cap from the substantially tubular element and/or pierces said cap, for opening a passage from the beverage container to a tapping line connected to the operating element, wherein the operating element comprises an end portion provided with extending elements for engaging the end of the substantially tubular element when the cap is removed at least in part from the substantially tubular element, for locking the operating element within the substantially tubular element, such that the operating element is prevented from moving back again into the tubular element.

35. A beverage container, wherein a closure is provided in and/or on a neck region of the beverage container, comprising a substantially tubular element at the neck region, having a peripheral wall, and an operating element fit inside said substantially tubular element, slidingly sealing against the peripheral wall, wherein a cap is fitted at or near an end of the substantially tubular element, closing off the substantially tubular element, wherein the operating element can be pushed into the substantially tubular element to such extent that the operating element at least partly removes the cap from the substantially tubular element and/or pierces said cap, for opening a passage from the beverage container to a tapping line connected to the operating element, wherein the operating element comprises or is connected to, at a side opposite a forward end facing the cap, a dispense line, wherein the operating element further is provided at said side with an outward flaring surface surrounding a part of the dispense line, wherein the dispense line is supported by the flaring surface during use, further comprising a tapping valve operating system, to which a valve provided in and/or on the dispense line can be connected, such that with the tapping valve operating system a passage of the dispense line can be brought into fluid communication with the environment for dispensing a beverage from the beverage container or blocked there from for interrupting or preventing such dispensing.

* * * * *